US011661256B2

(12) United States Patent
Boutwell et al.

(10) Patent No.: US 11,661,256 B2
(45) Date of Patent: May 30, 2023

(54) PACKAGING SYSTEM FOR AN APPLIANCE

(71) Applicant: Electrolux Home Products, Inc., Charlotte, NC (US)

(72) Inventors: Rodney Boutwell, Greenbrier, TN (US); Kirankumar Rao, Greenbrier, TN (US); Kurt Schauwecker, Nashville, TN (US); Sooraj Puthiyaveetil, Hendersonville, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/464,828

(22) Filed: Sep. 2, 2021

(65) Prior Publication Data

US 2023/0063873 A1 Mar. 2, 2023

(51) Int. Cl.
*B65D 81/05* (2006.01)
*B65D 85/68* (2006.01)

(52) U.S. Cl.
CPC ..... *B65D 81/054* (2013.01); *B65D 85/68* (2013.01)

(58) Field of Classification Search
CPC . B65D 5/44; B65D 6/22; B65D 25/54; B65D 81/02; B65D 81/05; B65D 81/054; B65D 85/68; B65D 5/445
USPC ..... 206/279, 288, 289, 298, 320, 508, 509, 206/511, 512; 229/125.01
See application file for complete search history.

(56) References Cited

U.S. PATENT DOCUMENTS 5,161,692 A 11/1992 Knierim
5,307,928 A * 5/1994 Bishop ..... B65D 5/5033 206/320
7,048,118 B2 5/2006 Baechle
8,061,521 B1 * 11/2011 Lowry ..... B65D 19/44 206/592

(Continued)

FOREIGN PATENT DOCUMENTS

CN 201400404 2/2010
CN 202912164 5/2013

(Continued)

OTHER PUBLICATIONS

Partial International Search Report and Written Opinion for PCT/US2022/041348, dated Nov. 28, 2022, 17 pages.

(Continued)

*Primary Examiner* — Bryon P Gehman
(74) *Attorney, Agent, or Firm* — Pearne & Gordon LLP

(57) ABSTRACT

A packaging system includes first and second caps, each cap having a main panel, first and second side panel assemblies extending from and substantially perpendicular to the main panel, a plurality of stacking protuberances, and a plurality of stacking sockets. The cap is stackable with an identical cap by mating the protuberances of the cap with the sockets of the identical cap. The packaging system further includes an elongated post; an elongated brace; and a packaging block fixed to the main panel of the first cap. The side panel assemblies of the first cap are adjacent to one another and together with the packaging block define a post socket that receives an end portion of the post and inhibits lateral movement of the post. Moreover, the side panel assemblies of the second cap are opposed to one another and respectively support first and second ends of the brace.

21 Claims, 8 Drawing Sheets

(56) References Cited

U.S. PATENT DOCUMENTS

| | | | | |
|---|---|---|---|---|
| 8,413,836 | B2 * | 4/2013 | Senn | B65D 5/446 220/651 |
| 8,833,573 | B2 | 9/2014 | Tomaszewski et al. | |
| 9,428,298 | B2 * | 8/2016 | Bersamin | B65D 5/006 |
| 9,783,333 | B1 * | 10/2017 | De Los Santos | B65D 5/006 |
| 11,427,375 | B2 * | 8/2022 | Hariharan | B65D 5/445 |
| 2005/0061863 | A1 | 3/2005 | Quaintance et al. | |

FOREIGN PATENT DOCUMENTS

| | | |
|---|---|---|
| CN | 107640439 | 1/2018 |
| CN | 207450633 | 6/2018 |
| CN | 207747482 | 8/2018 |
| CN | 207773916 | 8/2018 |
| CN | 208715731 | 4/2019 |
| WO | 0020301 | 4/2000 |

OTHER PUBLICATIONS

International Search Report and Written Opinion for PCT/US2022/041348, dated Jan. 23, 2023, 22 pages.

* cited by examiner

PACKAGING SYSTEM FOR AN APPLIANCE

FIELD OF THE INVENTION

The present disclosure relates to a packaging system for an appliance and more particularly, a packing system comprising an upper assembly, a lower assembly, and a plurality of elongated posts.

BACKGROUND OF THE INVENTION

Packaging systems for appliances such as refrigerators, ovens, etc. can include a bottom cap that supports the appliance, elongated corner posts that are arranged vertically along the edges of the appliance, a top cap member that rests over a top of the appliance, and an outer box that contains the bottom and top caps, posts, and appliance. The packaging system is designed to protect the appliance during shipping, particularly along the areas in which the cap members and corners posts are arranged.

BRIEF SUMMARY OF THE INVENTION

The following presents a simplified summary of example embodiments of the invention. This summary is not intended to identify critical elements or to delineate the scope of the invention.

In accordance with a first aspect, a packaging system includes a cap having a main panel extending along a plane, first and second opposing side panel assembles extending respectively from first and second opposing edges of and substantially perpendicular to the main panel, and an elongated brace extending between the first and second side panel assemblies.

In accordance with a second aspect, a packaging system includes an elongated post; a cap having a main panel extending along a plane, and first and second side panel assemblies extending from and substantially perpendicular to the main panel; and a packaging block fixed to the main panel. The packaging block and the first and second side panel assemblies together define a socket that receives an end portion of the post, such that packaging block and the first and second side panel assemblies together inhibit lateral movement of the end portion along the plane.

In accordance with a third aspect, a cap for packaging includes a main panel extending along a plane; a plurality of side panel assemblies extending from and substantially perpendicular to the main panel; a plurality of stacking protuberances; and a plurality of stacking sockets. The stacking protuberances and stacking sockets are configured such that the cap is stackable with an identical cap by mating the stacking protuberances of the cap with the stacking sockets of the identical cap.

In accordance with a fourth aspect, a packaging system includes first and second caps, each cap having a main panel that extends along a plane, first and second side panel assemblies extending from and substantially perpendicular to the main panel, a plurality of stacking protuberances, and a plurality of stacking sockets. The stacking protuberances and stacking sockets are configured such that the cap is stackable with an identical cap by mating the stacking protuberances of the cap with the stacking sockets of the identical cap. The packaging system further includes an elongated post; an elongated brace; and a packaging block fixed to the main panel of the first cap. The first and second side panel assemblies of the first cap are adjacent to one another and together with the packaging block define a post socket that receives an end portion of the post and inhibits lateral movement of the post along the plane of the first cap. Moreover, the first and second side panel assemblies of the second cap are opposed to one another and respectively support first and second ends of the brace extending therebetween.

BRIEF DESCRIPTION OF THE DRAWINGS

The above and other features, aspects, and advantages of the present application are better understood when the following detailed description of the present application is read with reference to the accompanying drawings, in which.

DETAILED DESCRIPTION

Figure 1:
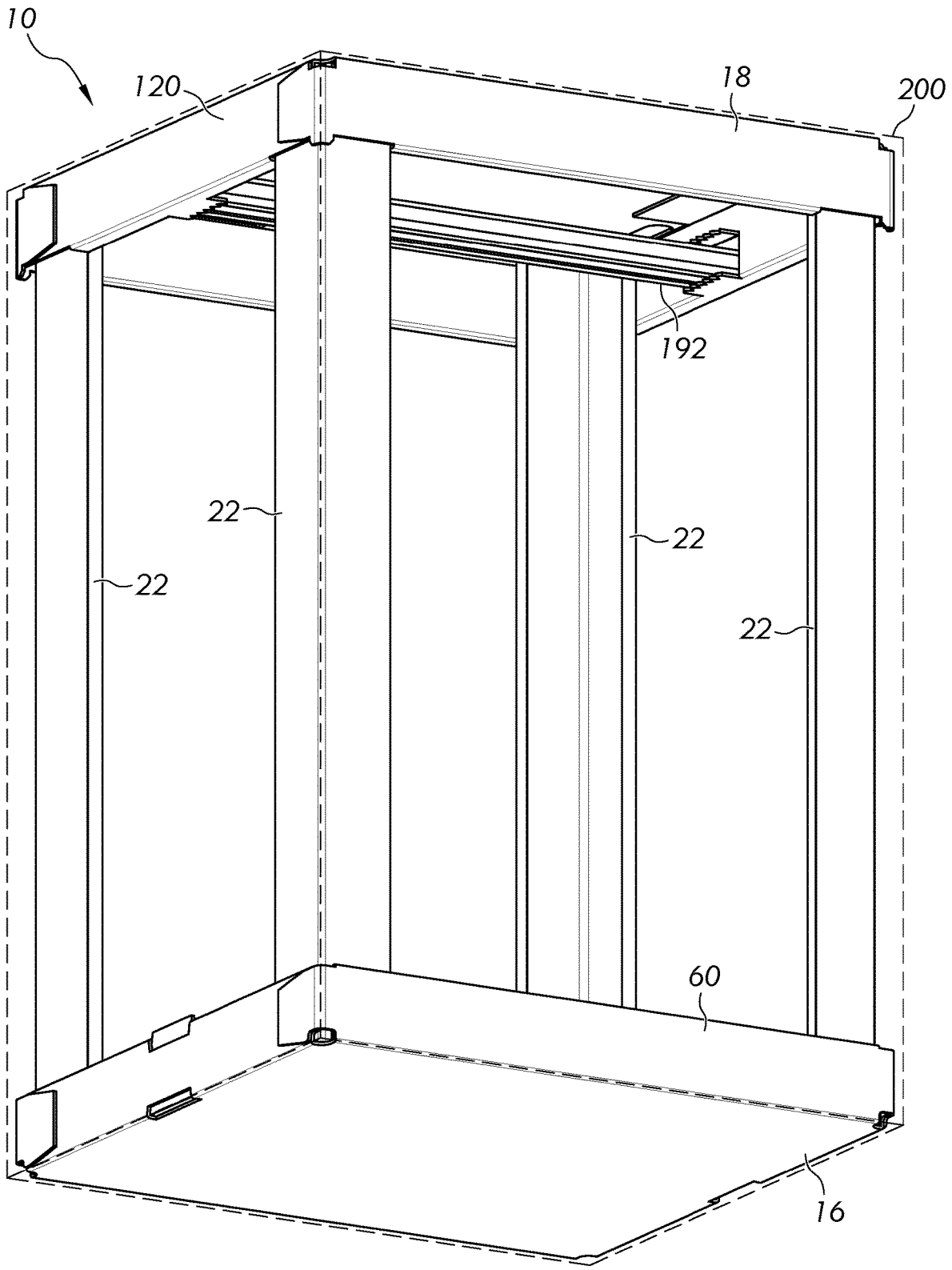
FIG. 1 is a perspective view of an example packaging system for an appliance.

Referring now to FIG. 1, an example packaging system 10 for an appliance (not shown) includes a lower assembly 16 that supports the appliance, an upper assembly 18 that covers and protects a top of the appliance, and a plurality of elongated posts 22 extending between the lower and upper assemblies 16, 18. The posts 22 rest on the lower assembly 16 and vertically support the upper assembly 18 while also protecting the corners of the appliance. The posts 22 also mate with the lower and upper assemblies 16, 18 so as to provide horizontal rigidity to the packaging system 10, as described further below.

Figure 2:
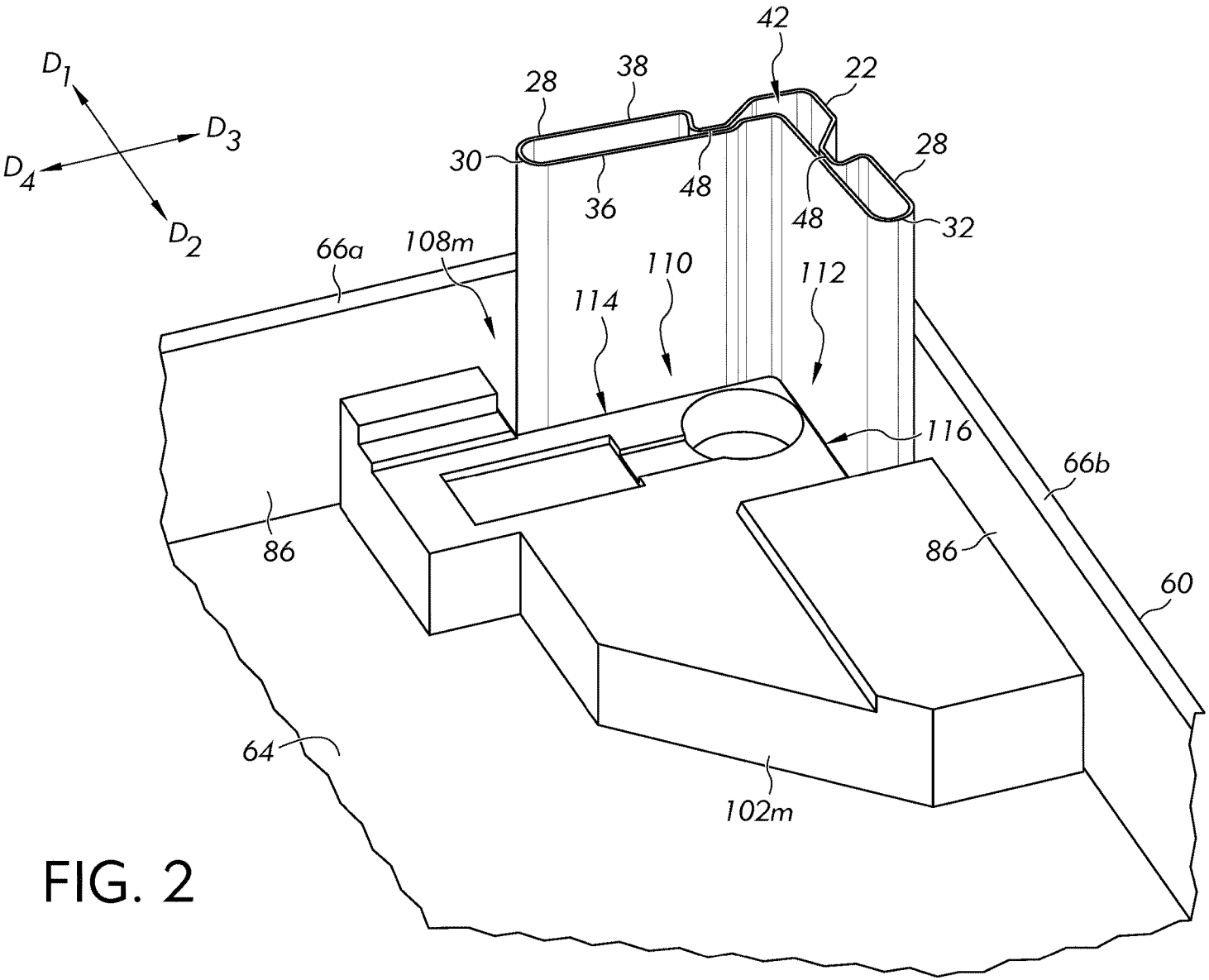
FIG. 2 is an enlarged, partial cross-section view of the packaging system.

As shown in FIG. 2, each post 22 is an elongated, tubular body preferably formed from a sheet of wound laminated paper. Each post 22 has first and second legs 26, 28 that preferably extend substantially perpendicular to each other and terminate in rounded ends 30, 32. The legs 26, 28 are formed by an inner wall 36 (defined as the wall closest the appliance) and an outer wall 38 (defined as the wall farthest from the appliance) that are continuous with each other and define a hollow core 42. Moreover, beads 48 may be formed in the outer wall 38 along each leg, which extend toward and abut the inner wall 36.

The packaging system 10 of the present embodiment has four "corner" posts 22 that are arranged at the corners of the lower and upper assemblies 16, 18 and will extend vertically along the edges of the appliance. However, the posts 22 may be arranged at other locations along the sides of the lower and upper assemblies 16, 18, and in some examples may be located inward from the sides and corners of the lower and upper assemblies 16, 18. Furthermore, the posts 22 can comprise other materials and configurations than described. For instance, each post 22 can comprise a single sheet of laminated paper that is folded to form a non-tubular body having first and second legs that are perpendicular or oblique to each other. As another example, each post 22 can comprise an elongated column of EPS with a solid core. Broadly speaking, each post 22 can be any elongated body that extends between the lower and upper assemblies 16, 18 to provide vertical and/or horizontal support to the packaging system 10.

Figure 3:
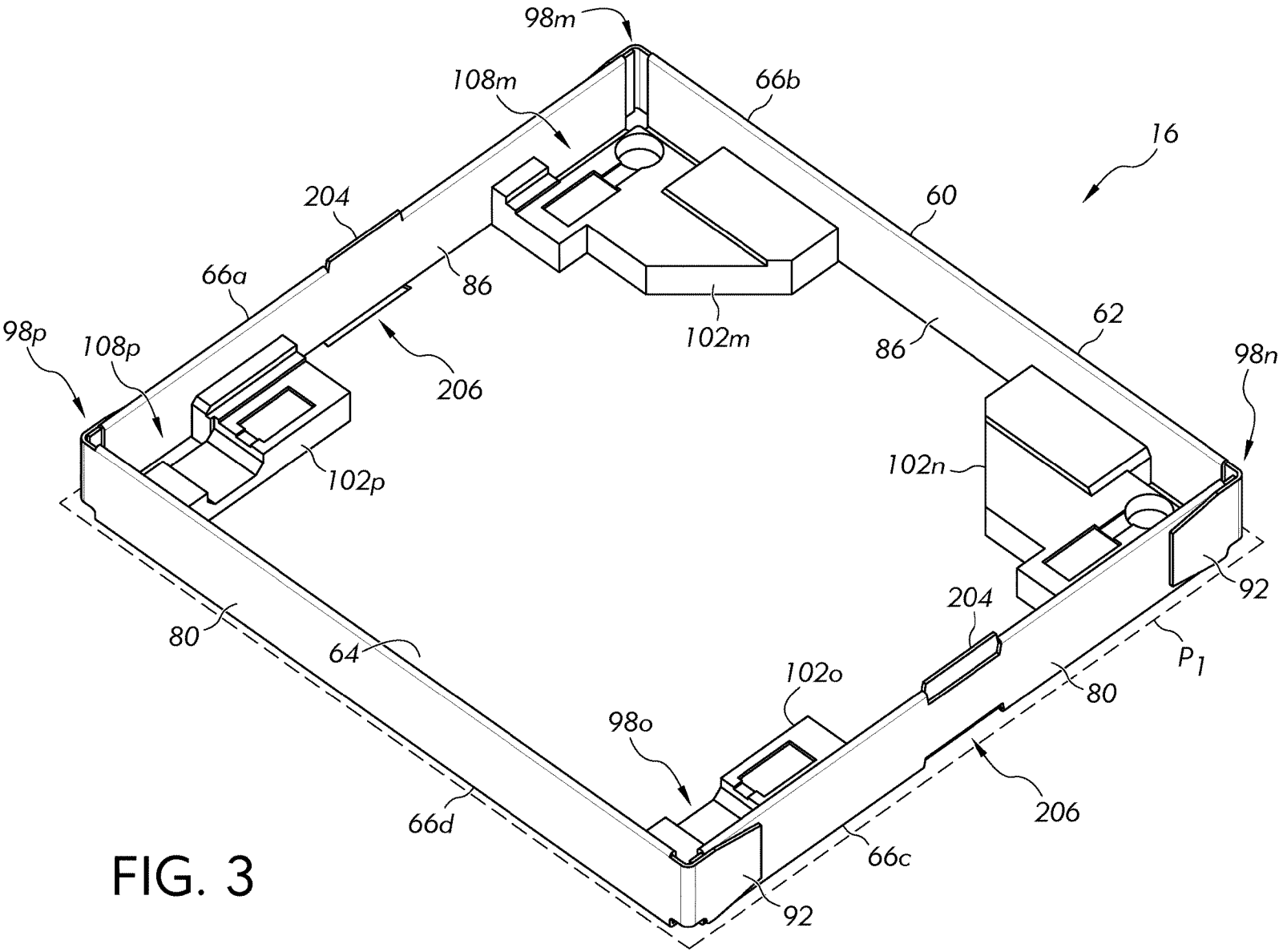
FIG. 3 is a perspective view of a lower assembly of the packaging system.
Figure 4:
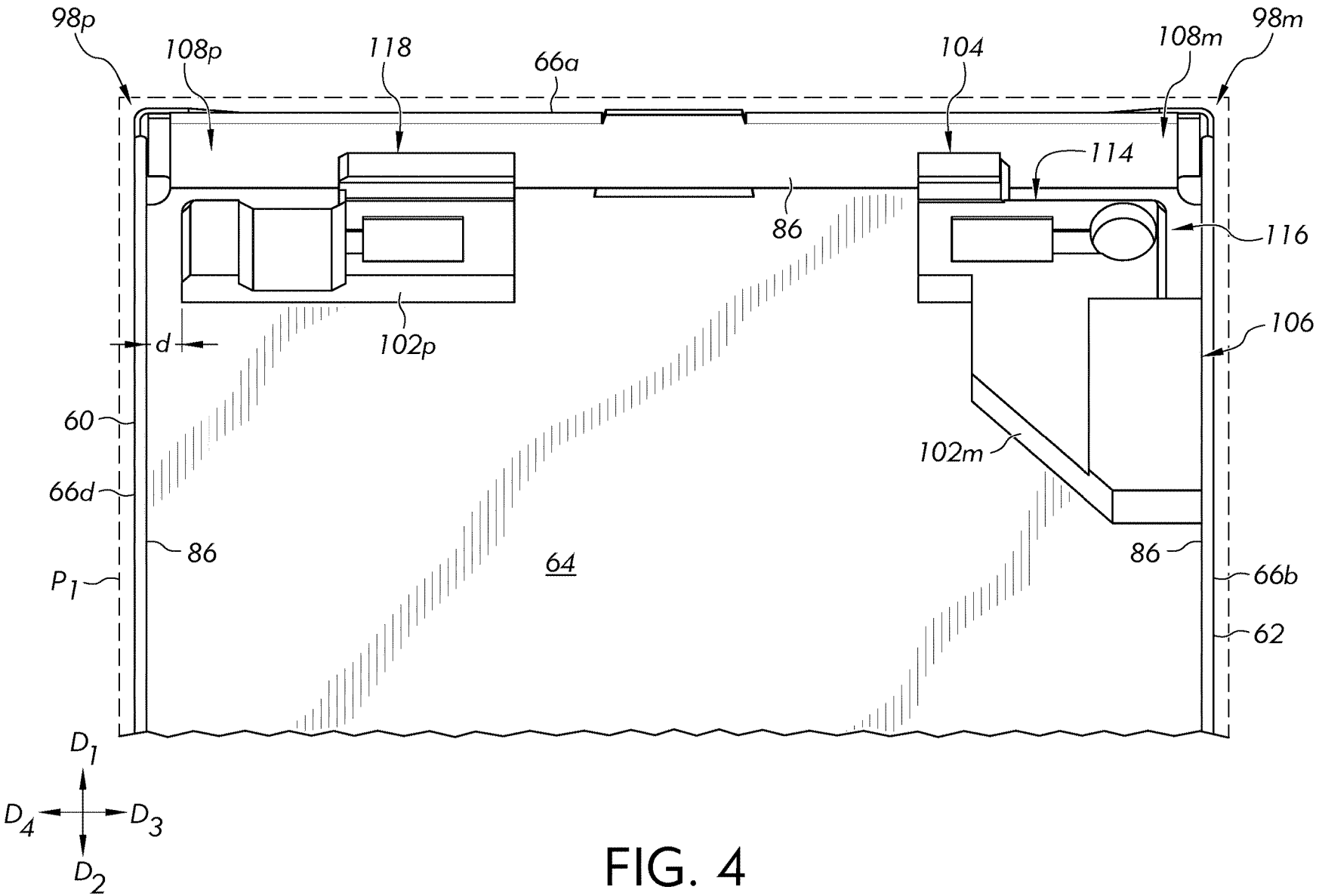
FIG. 4 is a partial top view of the lower assembly.
Figure 5:
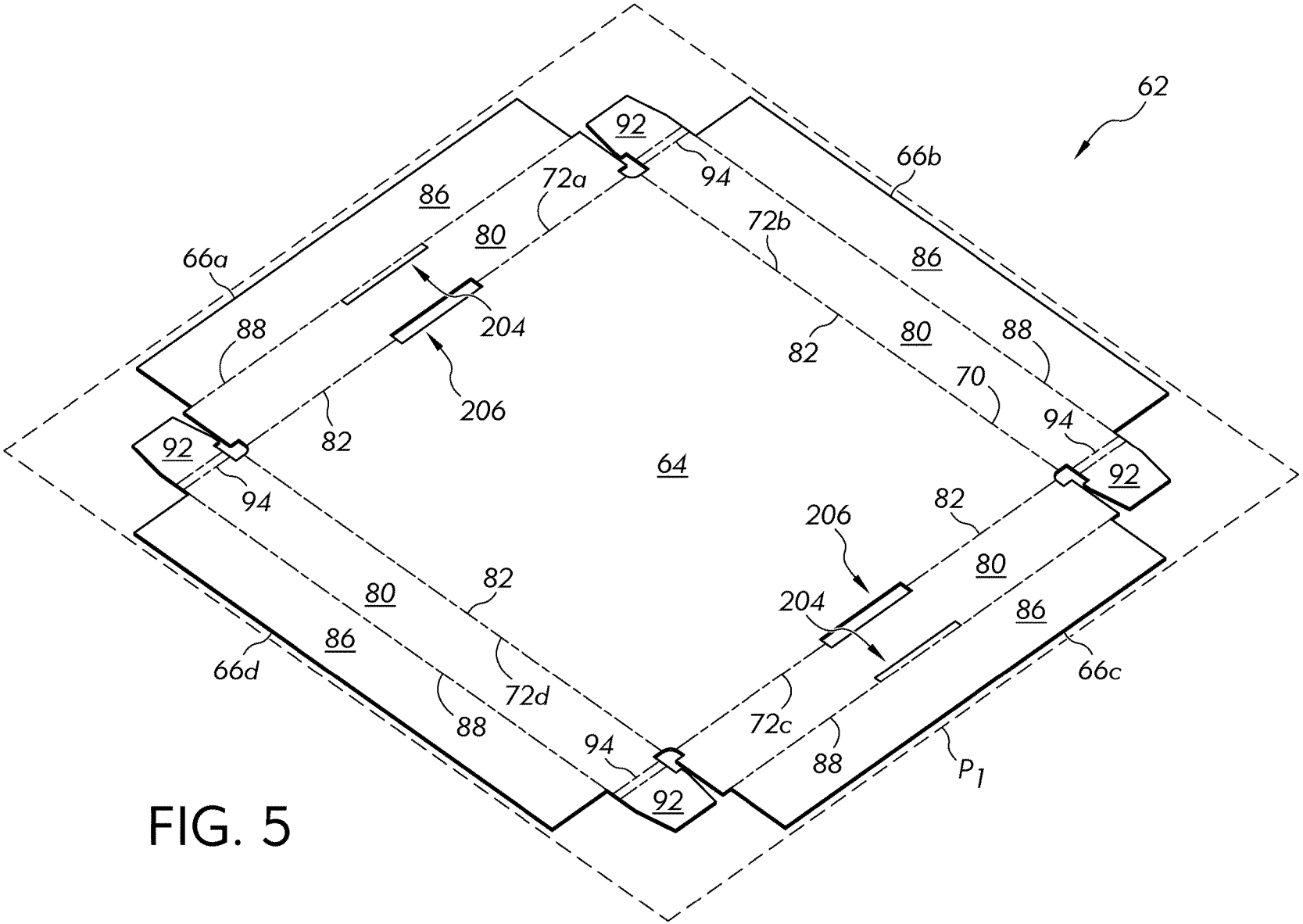
FIG. 5 is a perspective view of a cardboard blank used to form a bottom cap of the lower assembly, in an unfolded state.

Turning to FIGS. 3-5, the lower assembly 16 includes a bottom cap 60 comprising a single, unitary blank of cardboard 62 that is folded to form a main panel 64 and a plurality of side panel assemblies 66*a-d* extending from the main panel 64. FIGS. 3 and 4 show the blank 62 in its folded state, while FIG. 5 shows the blank 62 prior to folding (broken lines in FIG. 5 show the lines along which the blank 62 is folded to yield the bottom cap 60 shown in FIG. 3). The bottom cap 60 has a main panel 64 that defines a floor of the bottom cap 60, and four side panel assemblies 66*a-d* extending upward therefrom at the edges thereof. The main panel 64 and side panel assemblies 66*a-d* are formed by folding the blank 62 shown in FIG. 5 along the broken lines shown in that figure. FIG. 5 indicates corresponding portions of the unfolded blank 62 using the same reference numerals that will form the associated features and their sub-elements once the blank 62 is folded.

The main panel 64 of the bottom cap 60 is substantially planar, rectangular in shape, and extends along and defines a horizontal plane $P_1$. The main panel 64 has a perimeter 70 (see FIG. 5) with four edges 72*a-d* in the rectangular embodiment illustrated, although it is understood that the main panel 64 can comprise other shapes with more or fewer edges.

Each side panel assembly 66*a-d* is connected to and extends from a respective edge 72*a-d* of the main panel 64. In particular, each side panel assembly 66*a-d* includes an outer panel 80 that is connected to a respective edge 72*a-d* of the main panel 64, and is folded along line 82 coinciding with such edge 72*a-d* such that the outer panel 80 extends upward from the main panel 64, substantially perpendicular to the plane $P_1$. Each side panel assembly 66*a-d* further includes an inner panel 86 that extends from the outer panel 80 and is folded along line 88 defining an interface between them such that the inner panel 86 extends downward from that interface toward the main panel 64, substantially perpendicular to the plane $P_1$ and parallel to the adjacent outer panel 80. The opposing side panel assemblies 66*a* and 66*c* extend substantially parallel to each other, and the opposing side panel assemblies 66*b* and 66*d* also are substantially parallel. In the illustrated embodiment, each pair of opposing side panel assemblies extends substantially perpendicular to the other pair.

Moreover, two of the side panel assemblies 66*b*, 66*d* (comprising one opposing pair thereof) further include connecting tabs 92 that extend from lateral ends of their outer panels 80. The tabs 92 are folded along lines 94 and then fixed to the outer panels 80 of the adjacent side panel assemblies 66*a*, 66*c* constituting the other opposing pair (e.g., using adhesive and/or staples) such that the panel assemblies 66*a-d* collectively form a rigid frame that surrounds and extends upward from the edges of the main panel 64. Moreover, the bottom cap 60 as assembled has four corners 98*m-p* that are each defined by the main panel 64 and a pair of adjacent side panel assemblies 66*a-d*.

The lower assembly 16 further includes a plurality of packaging blocks 102*m-p* that are positioned on the main panel 64 of the cap member 60 at the corners 98*m-p*. Each block 102*m-p* is made from an EPS material and includes detailed geometries that are configured to mate with and support corresponding portions (e.g., corners, edges, etc.) of the appliance. However, the material and/or geometry of each block 102*m-p* can vary by embodiment. Generally speaking, each block 102*m-p* can be any block of material that is positioned on the main panel 64 and configured to support the appliance.

Additionally, each block 102*m-p* is configured to define a socket with adjacent side panel assemblies 66*a-d*, which can receive a lower end portion of a post 22 to inhibit horizontal movement thereof. For example, as shown in FIG. 4, the block 102*m* has abutment surfaces 104, 106 that are configured such that the block 102*m* can be set on the main panel 64 and moved toward the corner 98*m* of the bottom cap 60 until the abutment surfaces 104, 106 respectively contact and are flush with the inner panels 86 of the adjacent side panel assemblies 66*a*, 66*b*. The block 102*m* can then be fixed to the main panel 64 and/or side panel assemblies 66*a*, 66*b* using, for example, adhesive.

In this fixed position, the block 102*m* and side panel assemblies 66*a*, 66*b* will together define an L-shaped socket 108*m* that can receive a lower end portion of a post 22, as shown in FIG. 2. In particular, a first portion 110 of the socket 108*m* can receive the first leg 26 of the post 22, while a second portion 112 of the socket 108*m* can receive the second leg 28 of the post 22.

Moreover, the socket 108*m* defined between the block 102*m* and side panel assemblies 66*a*, 66*b* will together inhibit (i.e., prevent or limit) lateral movement of the lower end portion of the post 22 along the plane $P_1$, as well as rotation thereof about an axis perpendicular to plane $P_1$. In particular, the side panel assembly 66*a* will inhibit movement of the lower end portion of the post 22 in a first direction $D_1$; an abutment surface 114 of the block 102*m* will inhibit movement of the lower end portion in a second direction $D_2$ opposite to first direction $D_1$; the side panel assembly 66*b* will inhibit movement of the lower end portion in a third direction $D_3$ transverse (e.g., substantially perpendicular) to the first and second directions $D_1$, $D_2$; and an abutment surface 116 of the block 102*m* will inhibit movement of the lower end portion in a fourth direction $D_4$ opposite to third direction $D_3$, all four directions $D_{1-4}$ being along the plane $P_1$.

Preferably, the surfaces 114, 116 of the block 102*m* and the inner panels 86 of side panel assemblies 66*a*, 66*b* will directly abut the lower end portion of the post 22 such that no movement is permitted in the four directions $D_{1-4}$.

As another example, the block 102*p* can be set on the main panel 64 and moved toward the corner 98*p* of the bottom cap 60 until it is a predetermined distance d from the inner panel 86 of side panel assembly 66*d* and an abutment surface 118 of the block 102*p* is flush with and contacts the inner panel 86 of the adjacent side panel assembly 66*a*. The block 102*p* can then be fixed to the main panel 64 and/or side panel assemblies 66*a*, 66*d* using, for example, adhesive. In this fixed position, the block 102*p* and side panel assemblies 66*a*, 66*d* will together define an L-shaped socket 108*p* that can similarly receive an end portion of another post 22 and inhibit lateral movement (or rotation) of the end portion of that post 22 along (or about an axis perpendicular to) the plane $P_1$.

The other two blocks 102*n*, 102*o* can be similarly configured to define sockets at their respective corners 98*n*, 980. In this manner, all four posts 22 can be inserted into associated sockets 108 of the lower assembly 16 such that each post 22 rests on the main panel 64 and is inhibited from moving horizontally (laterally). However, the blocks 102*m-p* can comprise a variety of other configurations that define respective sockets 108 for the posts 22. For example, two or more blocks 102*m-p* can be integrated into a single block that defines sockets 108 at multiple corners 98. In some examples, all four blocks 102*m-p* can be integrated into a single block that spans across the main panel 64 and defines a socket 108 at every corner 98 of the cap member 60.

Figure 6:
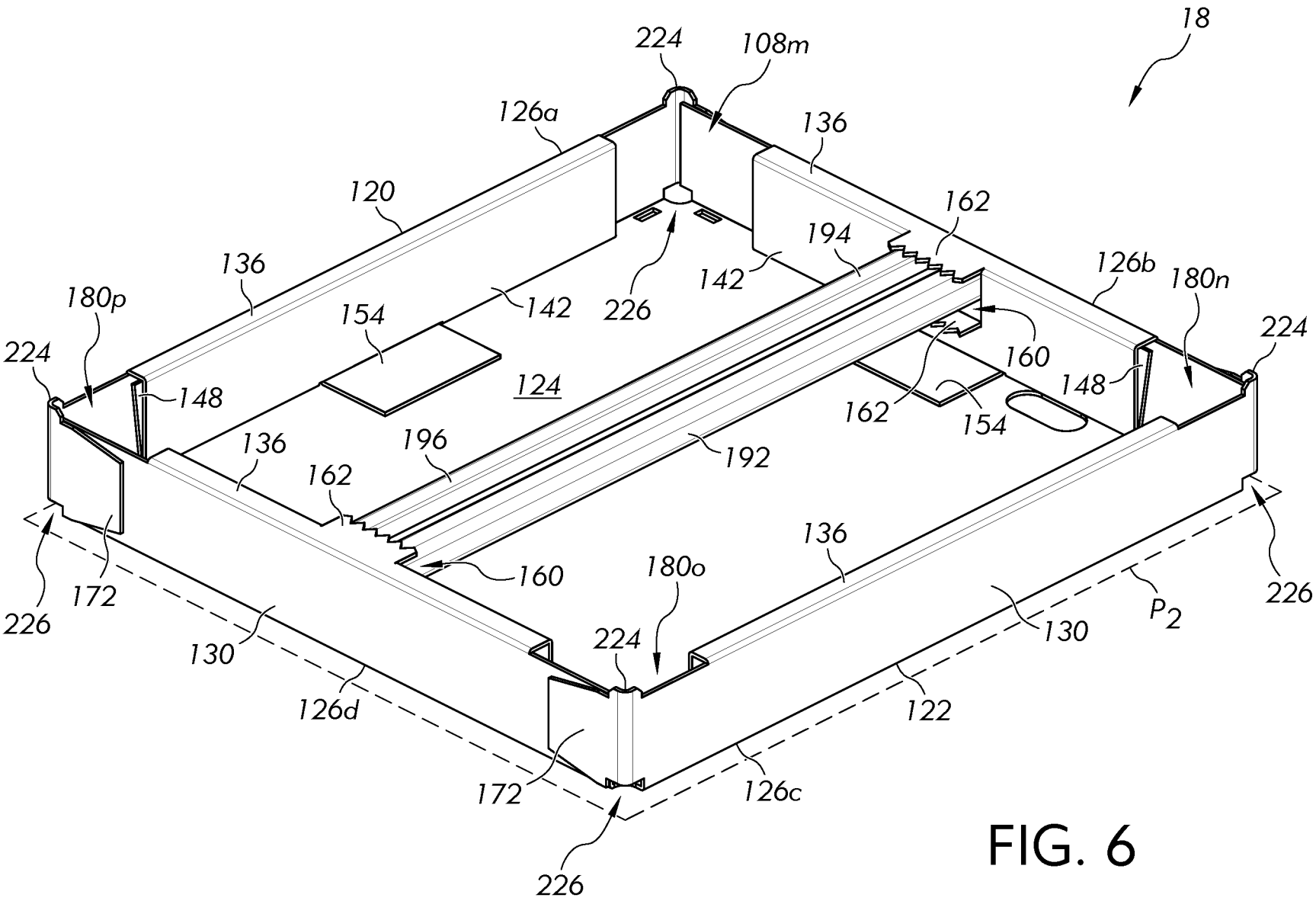
FIG. 6 is a perspective, bottom view of an upper assembly of the packaging system.
Figure 7:
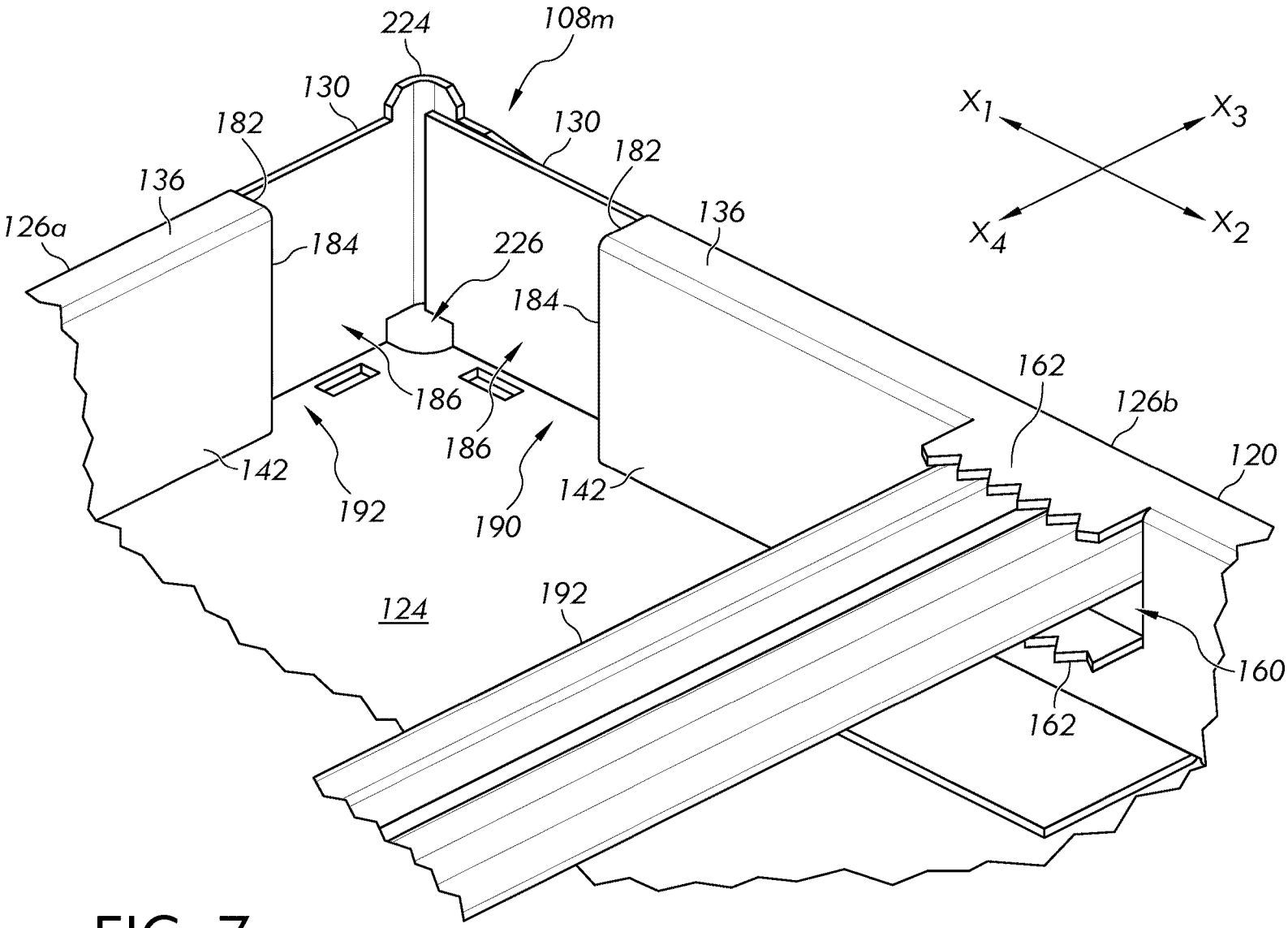
FIG. 7 is an enlarged, perspective bottom view of the upper assembly.
Figure 8:
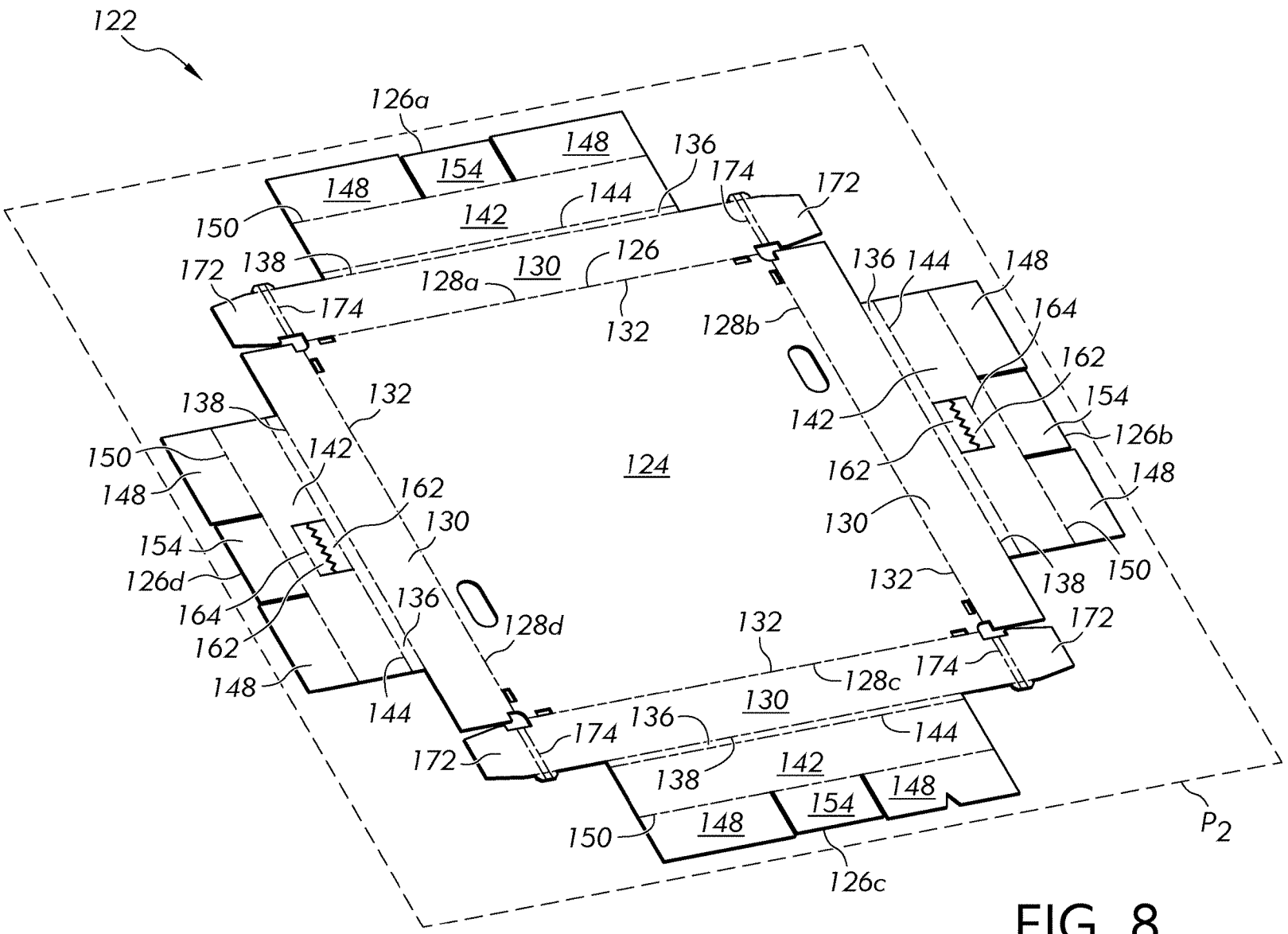
FIG. 8 is a perspective view of a cardboard blank used to form a top cap of the upper assembly, in an unfolded state.

Turning to FIGS. 6-8, the upper assembly 18 similarly includes a top cap 120 made from folding a single, unitary blank of cardboard 122 that is folded to form a main panel 124 and a plurality of side panel assemblies 126*a-d* extending from edges of the main panel 124. FIGS. 6 and 7 show the completed top cap 120 formed from the blank 122, while FIG. 8 shows the blank 122 prior to folding to form the top cap 120. Similarly as for the bottom cap 60 discussed above, the blank 122 is folded along fold lines (illustrated using broken lines in the figures) disposed at the interfaces between adjacent panels or sections of the bank 122. FIG. 8 indicates corresponding portions of the unfolded blank 122 using the same reference numerals that will form these features and their sub-elements once the blank 122 is folded to yield the top cap 120 (shown in FIGS. 6-7).

The main panel 124 of the top cap 120 is substantially planar and extends along and defines a plane $P_2$ of the top cap 120. The main panel 124 is rectangular and has a perimeter 126 (see FIG. 8) with four edges 128*a-d*, although it is understood that the main panel 124 can comprise other shapes with more or fewer edges.

Each side panel assembly 126*a-d* is connected to and extends from a respective edge 128*a-d* of the main panel 124. In particular, each side panel assembly 126*a-d* includes an outer panel 130 that is connected to the adjacent edge 128*a-d* of the main panel 124 and folded along line 132 such that the outer panel 130 extends perpendicular (i.e. downward) from the main panel 124 (when oriented as it will be in use), substantially perpendicular to the plane $P_2$. Each side panel assembly 126*a-d* also includes a lateral spacer 136 that is connected to the outer panel 130 along fold line 138 such that the lateral spacer 136 extends inward from the outer panel 130 substantially parallel to the plane $P_2$. An inner panel 142 of each side panel assembly 126*a-d* is connected to the spacer 136 and folded along fold line 144 such that the inner panel 142 extends downward from the lateral spacer 136 substantially perpendicular to and toward the plane $P_2$.

The pair of opposing side panel assemblies 126*a*, 126*c* extend substantially parallel to each other. The adjacent pair of side panel assemblies 126*b*, 126*d* also extend substantially parallel to one another, and perpendicular to the other pair. Moreover, each side panel assembly 126*a-d* includes a plurality of support tabs 148, 154 that are connected to and extend from the inner panel 142 (see FIG. 8). The outer support tabs 148 are folded along fold line 150 such that they extend outward and upward from the inner panel 142 (as seen in FIG. 6); and the center support tab 154 is folded along fold line 150 such that it extends inward from the inner panel 142 along the main panel 124.

One pair of opposing side panel assemblies 126*b*, 126*d* further include an aperture 160 defined at least partially by the associated inner panel 142, and a pair of flaps 162 that can be folded along respective fold lines 144, 164 to selectively block the aperture 160. The aperture 160 and flaps 162 are formed by making slits in the blank 122, wherein folding the flaps 162 of an aperture 160 along their respective fold lines effectively 'punches out' the blank to yield the aperture 160. However, it is to be appreciated that each panel assembly 126*b*, 126*d* in some examples can have a single flap 162 that folds to selectively block or 'punch out' the aperture 160. In other examples, each panel assembly 126*b*, 126*d* may simply define the aperture 160 without having any flaps.

The other pair of opposing side panel assemblies 126*a*, 126*c* (adjacent to the pair discussed in the preceding paragraph) further include connecting tabs 172 that extend from lateral ends of their outer panels 130. The tabs 172 are folded along fold lines 174 and then fixed to the outer panels 130 of the adjacent panel assemblies 126*a*, 126*c* (e.g., using adhesive and/or staples) such that all of the panel assemblies 126*a-d* collectively form a rigid frame that surrounds and extends downward (in the use orientation of the top cap 120) from the main panel 124. Moreover, in the fully formed top cap 120 the support tab 154 of each side panel assembly 126*a-d* can be affixed in planar adjacency to the main panel 124 (e.g., using adhesive see FIG. 6) to secure the inner panel 142 thereof in position, while the other support tabs 148 can function as braces for the spacer 136 and the inner panel 142 to add further rigidity thereto.

In the fully formed top cap 120, each pair of adjacent panel assemblies 126*a-d* will define a socket 180*m-p*, which can receive an upper end portion of a post 22 to inhibit horizontal (lateral) movement thereof. For example, as shown in FIG. 7, the panel assemblies 126*a*, 126*b* together define a socket 180*m* at a corner of the top cap 120. In particular, the socket 180*m* is defined by edges 182, 184 of the spacers 136 and inner panels 142, and inner surfaces 186 of the outer panels 130. A first portion 190 of the socket 180*m* can receive the first leg 26 of the post 22, while a second portion 192 of the socket 180*m* can receive the second leg 28 of the post 22.

The side panel assemblies 126*a*, 126*b* will together inhibit (i.e., prevent or limit) lateral (as well as rotational) movement of the end portion along (or about an axis perpendicular to) the plane $P_2$. In particular, the surface 186 of the panel assembly 126*a* will inhibit movement of the upper end portion of the post 22 in a first direction $X_1$; the edges 182, 184 of the side panel assembly 126*b* will inhibit movement of the upper end portion of the post 22 in a second direction $X_2$ opposite to first direction $X_1$; the surface 186 of the side panel assembly 126*b* will inhibit movement thereof in a third direction $X_3$ transverse (e.g., substantially perpendicular) to the first and second directions $X_1$, $X_2$; and the edges 182, 184 of the side panel assembly 126*s* will inhibit movement thereof in a fourth direction $X_4$ opposite to third direction $X_3$, all four directions $X_{1-4}$ being substantially along the plane $P_2$. Preferably, the surfaces 186 and edges 182, 184 of the side panel assemblies 126*a*, 126*b* will directly abut the upper end portion of the post 22 such that no movement is permitted in these four directions $X_{1-4}$.

The other sockets 180*n-p* in the upper assembly 18 can be similarly configured to receive upper end portions of other posts 22 and inhibit movement thereof along the plane $P_2$. In this manner, upper end portions of all four posts 22 can be inserted into associated sockets 180*n-p* such that each post 22 supports the top cap 120 and is inhibited thereby from moving horizontally (laterally). However, it is to be appreciated that the side panel assemblies 126*a-d* and sockets 180*n-p* can comprise other configurations that accomplish similar effects. For example, each side panel assembly 126*a-d* can comprise other configurations of folded elements defining surfaces and/or edges that form a socket with an adjacent side panel assembly 126*a-d*.

The upper assembly 18 further includes a support brace 192 having a first end 194 that is inserted into the aperture 160 of panel assembly 126*b*, and a second end 196 that is inserted into the aperture 160 of the opposing panel assembly 126*d*. The brace 192 is an elongated column of material (e.g., paper, EPS, etc.) preferably with a solid core, and has a length that approximates a distance (and which extends) between the outer panels 130 of the opposing panel assemblies 126*b*, 126*d*. Moreover, the brace 192 will rest along a bottom edge of the aperture 160, thus being supported by the side panel assemblies 126*b*, 126*d*. The brace 192 as installed can provide horizontal (lateral) support to the top cap 120 in the direction of brace's longitudinal axis; for example sufficient to oppose a clamping force of an external clamping machine used to capture and move the packaged appliance within the completed packaging assembly; i.e. packaged between top and bottom caps 120 and 160 with posts 22 extending vertically therebetween at the corners of the appliance. As a result, the brace 192 provides additional clamping support to the completed package so that the clamping force will not be experienced directly by the appliance. Rather, the clamping force will be transmitted largely through the brace 192 along its axis.

The packaging system 10 as described above can be assembled by placing the appliance on the blocks 102 of the lower assembly 16, inserting the posts 22 into the sockets 110 of the lower assembly 16, and then placing the upper assembly 18 on top of the appliance such that the upper ends of the posts 22 are received within its sockets 180. The entire assembly can then be covered in stretch or shrink wrap 200 (see FIG. 1) and shipped. In some examples, the wrapped assembly can be shipped within an outer, cardboard box, although it may be shipped without such a box in other examples. It is to be appreciated that the appliance can be any consumer appliance such as, for example, a refrigerator, oven, washer, dryer, dishwasher, etc.

As discussed above, the insertion of the posts 22 into the lower and upper sockets 110, 180 will inhibit horizontal movement of the posts 22 and add rigidity to the packaging system 10 as a whole. Moreover, the lower assembly 16, upper assembly 18, and posts 22 as assembled will protect the appliance. In some examples, additional packaging blocks made of EPS or some other material can be applied to any of these elements for added protection. For example, packaging blocks can be glued to the inner sides of the posts 22 or the main panels 64, 124 of the bottom and top caps 60, 120.

Preferably, the first and second legs 26, 28 of each post 22 will extend substantially perpendicular to each other so that the posts 22 properly fit into the lower and upper sockets 110, 180 during assembly. However, it has been found that if the posts 22 are manufactured at this angle and then stored for a period of time before assembly, they can warp over that time such that the angle decreases, thereby making it difficult to insert the posts 22 into the sockets 110, 180. Accordingly, in some examples, it may be desirable to manufacture each post 22 so that its first and second legs 26, 28 extend at an angle that is greater than 90 degrees to account for subsequent warping. In particular, it may be desirable to manufacture each post 22 so that its first and second legs 26, 28 extend at an angle that is between 95 degrees and 105 degrees, or between 100 degrees and 105 degrees. At these angles, each post 22 can still be inserted into the sockets 110, 180 by providing a slight bending force to reduce the angle to substantially 90 degrees. Moreover, the posts 22 can be stored for a period of time and still maintain an angle that is 90 degrees or more.

Still further, in some examples, the packaging system 10 and appliance will be transported using a device that applies a clamping force to the top cap 120. As noted above, the brace 192 can provide horizontal support to the top cap 120 in the clamping direction, thereby preventing damage to the top cap 120 and appliance.

The bottom and top caps 60, 120 can also include stacking elements that enable them to be stacked and aligned with multiple identical cap members. For example, the bottom cap 60 in the present embodiment includes a plurality of stacking protuberances 204 in the form of projections that are connected to and extend upward from the inner panels 86 of opposing side panel assemblies 66*a*, 66*c*, substantially perpendicular to and away from the main panel 64. The bottom cap 60 further includes a plurality of stacking sockets 206 in the form of apertures that are defined by the main panel 64 and outer panels 80 of the side panel assemblies 66*a*, 66*c*. The projections 204 and apertures 206 are configured such that the bottom cap 60 is stackable with an identical cap by inserting the projections 204 of the bottom cap 60 within the aligned apertures 206 of the identical cap. In particular, the projections 204 of the bottom cap 60 will be received within the apertures 206 of the identical cap so that the main panels 64 of the two caps are substantially parallel and their side panel assemblies 66*a-d* are substantially aligned.

Meanwhile, the opposing pair of side panel assemblies 126*a*, 126*c* of the top cap 120 each include a pair of stacking protuberances 224 in the form of projections that are connected to and extend downward (in the use orientation of the top cap 120) from lateral ends thereof, at the bends between their respective outer panel 130 and connecting tabs 172. In particular, the projections 224 extend substantially perpendicular and away from the main panel 124. Moreover, the main panel 124 and side panel assemblies 126*a-d* of the top cap 120 collectively define a plurality of stacking sockets 226 in the form of apertures at the corners of the top cap 120. The projections 224 and apertures 226 are arranged at the corners of the top cap 120 at lower and upper locations thereon, respectively (relative to the user orientation of the top cap 120) and are configured such that the top cap 120 is likewise stackable with an identical cap by inserting the projections 224 of the top cap 120 within the apertures 226 of the identical cap. In particular, the projections 224 of the top cap 120 will be received within the apertures 226 of the identical cap so that the main panels 124 of the two caps are substantially parallel and their respective panel assemblies 126*a-d* are substantially aligned.

In this manner, multiple bottom and top caps 60, 120 can be manufactured and stacked for later assembly with the rest of the packing system 10. However, it is to be appreciated that the number, shape, and/or location of the stacking elements described above can vary by embodiment. For instance, each cap 60, 120 can comprise any configuration of stacking protuberances (e.g., projections, bulges, lugs, shoulders, etc.) and stacking sockets (e.g., apertures, recesses, gaps, channels, etc.) such that the cap can be stacked with an identical cap by mating the protuberances of one with the sockets of the other.

As discussed above, the bottom and top caps 60, 120 are formed by folding respective single, unitary blanks of cardboard 62, 122. The cardboard preferably comprises a core of corrugated paper that is sandwiched between inner and outer liners of paper. However, the bottom and top caps 60, 120 may be formed of other types of cardboard or heavy-duty paper. Moreover, the bottom and top caps 60, 120 may comprise multiple pieces of cardboard or heavy-duty paper that are separately formed and then attached together, e.g. via lamination.

The respective side panel assemblies 66*a-d* and 126*a-d* of the bottom and top caps 60, 120 described above each have inner and outer panels, in addition to other elements such as connecting tabs. However, it is to be appreciated that any of the respective side panel assemblies 66*a-d*, 126*a-d* may comprise additional or fewer elements without departing from the scope of this disclosure. Indeed, in some examples, a panel assembly 66*a-d*, 126*a-d* may simply comprise a single panel that extends upward from its associated main panel.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A packaging system comprising:

a cap having a main panel extending along a plane, first and second side panel assemblies extending respectively from first and second opposing edges of and substantially perpendicular to the main panel, and an elongated brace extending between the first and second side panel assemblies, wherein the elongated brace rests on respective portions of the first and second side panel assemblies.

2. The packaging system of claim 1, said first and second side panel assemblies respectively supporting first and second ends of said elongated brace.

3. The packaging system of claim 2, each of said first and second opposing side panel assemblies comprising an outer panel and an inner panel substantially parallel thereto, wherein the elongated brace extends between the respective outer panels thereof, through respective apertures in the inner panels thereof.

4. The packaging system according to claim 3, wherein each of said first and second side panel assemblies further comprises a support tab that extends inward from the inner panel and is bonded directly to the main panel.

5. The packaging system according to claim 3, wherein each of said first and second side panel assemblies further comprises a support tab that extends outward from the inner panel, away from the main panel.

6. The packaging system according to claim 1, further comprising:

a third side panel assembly extending from a third edge of and substantially perpendicular to the main panel, and a post, wherein the first and third side panel assemblies together at least partially define a socket that receives an end portion of the post, such the first and third side panel assemblies together inhibit lateral movement of the post along the plane.

7. The packaging system according to claim 6, wherein:

the first side panel assembly inhibits movement of the end portion in a first direction, the third side panel assembly inhibits movement of the end portion in a second direction opposite to the first direction, the first side panel assembly inhibits movement of the end portion in a third direction substantially perpendicular to the first direction, and the third side panel assembly inhibits movement of the end portion in a fourth direction opposite to the third direction.

8. The packaging system according to claim 6, wherein:

the post includes a first leg and a second leg that extends substantially perpendicular to the first leg, the first side panel assembly at least partially defines a first portion of the socket that receives the first leg of the post, and the third side panel assembly at least partially defines a second portion of the socket that receives the second leg of the post.

9. The packaging system according to claim 1, wherein the cap comprises a plurality of stacking protuberances and a plurality of stacking sockets, the stacking protuberances and stacking sockets being configured such that the cap is stackable with an identical cap by mating the stacking protuberances of the cap with the stacking sockets of the identical cap.

10. The packaging system according to claim 1, wherein the cap comprises a single, unitary blank of cardboard that is folded to form the main panel and the plurality of side panel assemblies.

11. A packaging system comprising:

an elongated post;

a cap including:

a main panel extending along a plane, and first and second side panel assemblies extending from and substantially perpendicular to the main panel; and a packaging block fixed to the main panel, wherein the packaging block and the first and second side panel assemblies together define a socket that receives an end portion of the post, such that packaging block and the first and second side panel assemblies together inhibit lateral movement of the end portion along the plane.

12. The packaging system according to claim 11, wherein:

the first and second side panel assemblies respectively inhibit movement of the end portion in first and second directions that are substantially perpendicular to each other, the packaging block inhibits movement of the end portion in third and fourth directions that are respectively opposite to the first and second directions.

13. The packaging system according to claim 12, wherein the packaging block directly abuts the first and second side panel assemblies.

14. The packaging system according to claim 12, wherein the packaging block and the first and second side panel assemblies directly abut the end portion of the post.

15. The packaging system according to claim 11, wherein the cap comprises a single, unitary blank of cardboard that is folded to form the main panel and first and second side panel assemblies.

16. The packaging system according to claim 11, wherein the post comprises a first leg and second leg, an angle between the first leg and second leg being between 95 degrees and 105 degrees.

17. A cap for packaging, comprising:

a main panel extending along a plane; and a plurality of side panel assemblies extending from and substantially perpendicular to the main panel;

a plurality of stacking protuberances; and a plurality of stacking sockets, wherein the stacking protuberances and stacking sockets are configured such that the cap is stackable with an identical cap by mating the stacking protuberances of the cap with the stacking sockets of the identical cap.

18. The cap according to claim 17, wherein said stacking protuberances and stacking sockets are arranged at corners of the cap.

19. The cap according to claim 18, each stacking protuberance being a projection defined by an associated side panel assembly and extending therefrom along a direction perpendicular to and away from the main panel.

20. The cap according to claim 17, wherein the cap comprises a single, unitary blank of cardboard that is folded to form the main panel, the plurality of side panel assemblies, the plurality of stacking protuberances, and the plurality of stacking sockets.

21. A packaging system comprising:

first and second caps, each cap comprising:

a main panel that extends along a plane, first and second side panel assemblies extending from and substantially perpendicular to the main panel, a plurality of stacking protuberances, and a plurality of stacking sockets, wherein the stacking protuberances and stacking sockets are configured such that the cap is stackable with an identical cap by mating the stacking protuberances of the cap with the stacking sockets of the identical cap;

an elongated post;

an elongated brace; and a packaging block fixed to the main panel of the first cap, wherein the first and second side panel assemblies of the first cap are adjacent to one another and together with the packaging block define a post socket that receives an end portion of the post and inhibits lateral movement of the post along the plane of the first cap, and wherein the first and second side panel assemblies of the second cap are opposed to one another and respectively support first and second ends of the brace extending therebetween.

* * * * *